US009696101B2

(12) United States Patent
Kada

(10) Patent No.: US 9,696,101 B2
(45) Date of Patent: Jul. 4, 2017

(54) CONVERSION SET FOR A FIREARM AND METHOD FOR CONVERTING A FIREARM

(71) Applicant: Christian Kada, Leibnitz (AT)

(72) Inventor: Christian Kada, Leibnitz (AT)

( * ) Notice: Subject to any disclaimer, the term of this patent is extended or adjusted under 35 U.S.C. 154(b) by 0 days.

(21) Appl. No.: 14/898,057

(22) PCT Filed: Jun. 12, 2014

(86) PCT No.: PCT/AT2014/000119
§ 371 (c)(1),
(2) Date: Dec. 11, 2015

(87) PCT Pub. No.: WO2014/201478
PCT Pub. Date: Dec. 24, 2014

(65) Prior Publication Data

US 2016/0146558 A1 May 26, 2016

(30) Foreign Application Priority Data

Jun. 21, 2013 (AT) ..... 50411/2013

(51) Int. Cl.
*F41A 3/56* (2006.01)
*F41A 5/12* (2006.01)
(Continued)

(52) U.S. Cl.
CPC *F41A 3/56* (2013.01); *F41A 5/12* (2013.01); *F41A 11/02* (2013.01); *F41A 21/00* (2013.01)

(58) Field of Classification Search
CPC .... F41A 3/56; F41A 5/12; F41A 11/02; F41A 21/00; F41A 21/08; F41A 21/16; F41A 21/26; F41A 21/36; F41A 21/38; F41A 21/48; F41A 21/481; F41A 21/484; F41A 21/487; F41A 21/488; F41A 5/10; F41A 5/14
(Continued)

(56) References Cited

U.S. PATENT DOCUMENTS 3,273,460 A * 6/1965 Mason ..... 89/185
3,711,980 A * 1/1973 Palama ..... F41C 5/00 42/16
(Continued)

FOREIGN PATENT DOCUMENTS

CZ WO 2008049378 A1 * 5/2008 ..... F41A 3/54
DE 1 034 071 7/1958
(Continued)

OTHER PUBLICATIONS

NPL: http://www.ncggasgun.com/.*
(Continued)

*Primary Examiner* — John D Cooper
(74) *Attorney, Agent, or Firm* — Henry M. Feiereisen, LLC

(57) ABSTRACT

A conversion set for a firearm having a grip and a slide locked by a moveable barrel and including an ejecting opening is disclosed. To permit timely opening of the slide when using a replacement barrel which does not lock the slide, the conversion set for use of a replacement barrel which does not lock the slide includes a jacket which may be connected to the slide in a detachable, form-fitting manner. The jacket has a defined mass for the predetermined movement of the slide following a shot being fired.

15 Claims, 12 Drawing Sheets

(51) Int. Cl.
*F41A 11/02* (2006.01)
*F41A 21/00* (2006.01)

(58) Field of Classification Search
USPC ..... 42/16, 1.06
See application file for complete search history.

(56) References Cited

U.S. PATENT DOCUMENTS 3,866,516 A * 2/1975 Frisoli ..... F41D 3/06 89/190
4,048,901 A * 9/1977 Ghisoni ..... F41C 3/00 89/132
4,127,056 A * 11/1978 Kart ..... F41C 5/00 89/128
4,220,071 A * 9/1980 Seiderman ..... F41D 7/03 89/128
4,327,626 A * 5/1982 McQueen ..... F41D 7/08 89/197
4,580,484 A * 4/1986 Moore ..... F41D 5/08 89/128
4,608,909 A * 9/1986 Peters ..... F41C 21/22 89/196
4,709,497 A * 12/1987 Resca ..... F41C 21/22 42/75.02
4,909,129 A * 3/1990 Reynolds ..... F41D 5/10 89/191.01
5,046,275 A * 9/1991 Brown ..... F41A 11/02 42/25
5,225,610 A * 7/1993 Uria ..... F41A 3/58 42/40
5,325,617 A * 7/1994 Vojta et al. ..... F41A 21/48 42/75.03
5,581,046 A * 12/1996 Weldle et al. ..... F41A 25/12 89/196
5,808,229 A * 9/1998 Bastian et al. ..... F41A 5/04 89/163
6,357,331 B1 * 3/2002 Dionne ..... F41A 21/10 89/29
6,571,501 B1 * 6/2003 Jennings ..... F41A 17/36 42/70.02
7,975,596 B2 * 7/2011 Darian ..... F41A 5/00 89/191.01
8,418,389 B1 * 4/2013 Lukman et al. ..... 42/1.06
2002/0116857 A1 * 8/2002 Wonisch et al. ..... F41A 21/00 42/75.02
2005/0257413 A1 * 11/2005 Zimmermann ..... F41A 21/00 42/75.1
2007/0012170 A1 * 1/2007 Spielberger ..... 89/196
2010/0031812 A1 * 2/2010 Kerbrat et al. ..... F41A 3/38 89/190
2012/0048104 A1 * 3/2012 Bryant et al. ..... F41A 5/18 89/191.01
2012/0085010 A1 4/2012 Cook
2013/0047833 A1 * 2/2013 Steimke et al. ..... F41A 5/18 89/191.01
2013/0145669 A1 * 6/2013 Zonshine ..... 42/75.02
2015/0247697 A1 * 9/2015 Hangen ..... F41C 23/06 42/1.06

FOREIGN PATENT DOCUMENTS

DE 197 22 806 9/1998
DE WO 2005108900 * 11/2005 ..... F41A 3/56
DE WO 2005108900 A1 * 11/2005 ..... F41A 3/56
EP 0 131 672 1/1985
FR 2 568 994 2/1986
WO WO 2005/108900 11/2005
WO WO 2008/049378 A1 * 2/2008 ..... F41A 3/54 42/1.06

OTHER PUBLICATIONS

NPL: http://www.everydaynodaysoff.com/2013/08/02/gtfo-with-your-low-speed-high-drag-rubber-glock-cover/ Aug. 2, 2013.*
NPL: http://www.forgottenweapons.com/other-handguns/volkspistole-walther/.*
H. Malalla: Mit einem Handgriff (With one hand movement), in: DWJ Deutsches Waffen Journal, vol. 47, No. 2; Feb. 1, 2011.
International Search Report issued by the European Patent Office in International Application PCT/AT2014/000119.

* cited by examiner

CONVERSION SET FOR A FIREARM AND METHOD FOR CONVERTING A FIREARM

CROSS-REFERENCES TO RELATED APPLICATIONS

This application is the U.S. National Stage of International Application No. PCT/AT2014/000119, filed Jun. 12, 2014, which designated the United States and has been published as International Publication No. WO 2014/201478 and which claims the priority of Austrian Patent Application, Serial No. A 50411/2013, filed Jun. 21, 2013, pursuant to 35 U.S.C. 119(a)-(d).

BACKGROUND OF THE INVENTION

The invention relates to a conversion set for a firearm having a grip and a slide locked by a movable barrel and comprising an ejecting opening.

The invention further relates to the use of such a conversion set.

The invention further relates to a method for converting a firearm with a grip and a slide locked by a movable barrel and comprising an ejecting opening.

The invention finally also relates to a method for operating a firearm with a grip and a slide locked by a movable barrel and comprising an ejecting opening, wherein the slide is moved to the rear after a shot is fired.

Firearms, especially automatic pistols, usually comprise a slide which closes a barrel on the rear side when a shot is fired. After the firing of the shot, the slide usually opens automatically, through which a cartridge case can be removed from the chamber. In order to prevent injuries, the slide will only open when the gas pressure has decreased to a safe level. A respectively timely opening of the slide can be achieved on the one hand by an unlocked slide which has a defined mass, so that a rearward movement can be initiated slowly enough as a result of mass inertia. On the other hand, locked slide systems are known, wherein the slide is connected to the barrel by massive locking elements when a shot is fired. A lower weight of the firearm can thus be achieved in comparison with an unlocked slide.

In a Browning system, which is frequently used for pistols, the slide is connected by a locking comb to a movable barrel when a shot is fired. After the firing of the shot, the slide plus barrel are moved to the rear by gas pressure relative to the grip of the pistol. In this process, the barrel performs a tilting movement to the rear and downwardly which is defined by a control cam in the grip, while the slide is moved linearly to the rear. As a result of the different movement of barrel and slide, the barrel is separated during movement from the slide, through which the slide is unlocked. Subsequently, an ejecting opening between the barrel and the slide is released. The tilting of the barrel to the rear and in the downward direction also produces the effect that a cartridge case situated in the chamber of the barrel is accelerated to the rear and in the downward direction. As a result, the cartridge case strikes a cartridge ejector which is usually arranged beneath a barrel axis or in a rear part of the grip and beneath the chamber. During subsequent bouncing from the cartridge ejector, the cartridge case is ejected through the ejecting opening out of the firearm.

Once the slide has reached a rear dead centre, it is moved in the forward direction again by a closing spring which is tensioned to the rear during movement, wherein a cartridge moving in from a magazine is introduced by the slide face of the slide and via a feed ramp into the chamber. In this process, the barrel is also entrained in the forward direction to an initial position, so that the firearm is locked again and ready to fire. A cartridge extractor is frequently provided in the slide in order to guide and extract the cartridge case reliably on the slide face.

Such firearms comprising a Browning system are light and insensitive to dirt, which is why such pistols, like a so-called Glock pistol, are frequently used by police units for example. A Glock pistol is a pistol which is produced by the Glock company. It is disadvantageous however that these pistols, as a result of the movable or tilting short barrel, only show low intrinsic accuracy and low ranges of up to approximately 50 m. Although the intrinsic accuracy can be improved by using a longer and/or non-tilting replacement barrel, the replacement of the tilting short barrel by such a replacement barrel is not compatible with the Browning system.

The replacement of the tilting short barrel by a replacement barrel which locks the slide leads especially to the consequence that an opening of the slide does not occur in due time or is impossible, and a cartridge case cannot be ejected. When using a replacement barrel that does not lock the slide, the slide opens too early, thus leading to a high risk of injury.

This is exactly where the invention comes into play. It is the object of the invention to provide a conversion set of the kind mentioned above with which timely opening of the slide is ensured when a replacement barrel that does not lock the slide is used for increasing the precision of the firearm.

It is a second object of the invention to provide the use of such a conversion set.

It is further an object of the invention to provide a method of the kind mentioned above with which a firearm can be converted easily, so that timely opening of the slide after firing a shot is ensured when a replacement barrel that does not lock the slide is used for increasing the precision of the firearm.

It is further an object of the invention to provide a method for operating a firearm of the kind mentioned above, wherein an improved precision of the firearm is achieved and timely opening of the slide is ensured.

SUMMARY OF THE INVENTION

The first object is achieved in accordance with the invention by a conversion set of the kind mentioned above which comprises a jacket which may be connected to the slide in a detachable, interlocking manner for use of a replacement barrel which does not lock the slide, wherein the jacket has a defined mass for the predetermined movement of the slide after firing a shot.

As a result of the jacket connected to the slide, the mass to be accelerated after the firing of a shot is increased, as a result of which the slide, which then acts as a blowback, opens in a timely manner, even when a barrel is inserted which does not lock the slide. A mass of the jacket is thus the result of a mass of the slide, inserted ammunition and a desired delay time between the firing of a shot and the ejection of the cartridge case. As a result, a firearm with a movable short barrel and low precision can be converted simply and reversibly into a firearm of high precision or with high intrinsic accuracy.

Since such a jacket can be arranged simply, e.g. as a steel part, the conversion set can be produced at low cost and can be transported easily.

It is advantageous for an especially good connection between the jacket and the slide if the jacket is formed to surround the slide. The jacket preferably surrounds the slide in a converted firearm on five sides, wherein the jacket laterally comprises an ejecting opening which corresponds to an ejecting opening of the slide and comprises on the front side a usually round opening for the barrel. During conversion, the jacket is usually placed over the slide or inserted thereon, so that an interlocking connection is provided which can be produced easily.

It is advantageous if a cocking slide is arranged on the jacket in order to easily repeat the slide when the jacket is mounted. The cocking slide can be formed directly, e.g. by a pin which is usually releasably connected to the jacket, or indirectly by a part which is movably mounted in a housing. In the case of such an indirect configuration, only one contact surface for the cocking slide is provided in the jacket in order to achieve simple construction.

It is advantageous if the jacket comprises a recess on the front side for a recoil spring guide, so that good mobility of the slide plus jacket is provided in relation to the grip and the recoil spring guide connected to the grip.

It can also be provided that a contact surface for the closing spring is provided directly on a front side of the jacket, especially when the jacket is formed for a firearm in which a so-called bushing is not mandatory, e.g. a so-called Colt M1911 pistol.

In many pistols such as the Glock pistol it is possible to enable automatic fire operation by attaching an automatic fire device in the jacket. A lever or a button for switching over between automatic fire operation and single-fire operation can be positioned in the jacket or in a housing connected to the pistol in order to achieve a simple configuration. It is advantageous if a jacket for a pistol with an automatic fire device arranged in the slide, e.g. a Clock pistol model 18, comprises a recess through which a switch lever or switch button of the automatic fire device can be operated for simple operation thereof.

The jacket advantageously comprises a fixing recess for fixing to the slide by a cartridge extractor protruding from the ejecting opening. A highly stable, interlocking connection between the jacket and the slide can thus be formed. Especially in the case of Glock pistols, the cartridge extractor protrudes from the ejecting opening of the slide when a cartridge is loaded, so that fixing can be ensured in a simple way by a respectively corresponding recess in the jacket. Furthermore, the jacket is fixed to the slide by the replacement barrel inserted in the converted firearm and is guided during a movement to the rear on the replacement barrel.

In order to ensure a function of a slide stop, it is advantageous if the jacket comprises a slide catch which expands a slide catch of the slide in order to increase the contact surface with the slide stop. As a result, excessive pressing of a surface on the slide which is used as a slide catch can be prevented in a simple way, which excessive pressing may lead to damage.

It is advantageous if the conversion set comprises a return device which can be connected to the firearm, by which a force can be exerted approximately in the direction of a cartridge ejector arranged in the firearm on a cartridge case situated in the slide. A movement of the cartridge case in relation to the cartridge ejector is achieved with such a return device during a movement of the slide plus the cartridge case to the rear, usually in the downward direction. This also ensures contact of the cartridge case with the cartridge ejector even when a barrel rigidly connected to the grip is inserted and the cartridge ejector is arranged beneath the barrel axis or beneath the chamber, as is usually the case in a Glock pistol. Reliable ejection of a cartridge case in such a firearm shall be achieved with such a return device even when a rigid replacement barrel is inserted.

Such a return device is not necessary for firearms in which the cartridge ejector is not arranged beneath the barrel axis or beneath the chamber. Such firearms comprise a groove in a slide face, through which a central cartridge ejector protrudes, onto which the cartridge case strikes after firing a shot and is thus ejected.

A constructionally simple and robust configuration is achieved if the return device is arranged in the jacket, preferably at a position corresponding to the ejecting opening.

The return device is preferably formed as a flat spring. This ensures a highly cost-effective producibility. If the flat spring is positioned in the jacket, a connection of the flat spring with the jacket usually occurs in an interlocking fashion by a shaped groove, e.g. a dovetail groove, The flat spring, which is usually arranged between the jacket and the slide, can also be connected at an additional bend by a connecting means such as a screw or bolt to the jacket at a fastening depression.

It is advantageous if the flat spring is arranged at a position in the jacket which corresponds to a groove for a barrel lug in the slide. As a result, the flat spring can protrude through this groove into the firearm, thus enabling conversion with especially low effort.

When a cartridge is supplied from the magazine from below, the flat spring is pressed upwardly, wherein an approximately vertical force is exerted downwardly on the cartridge. Lifting of the jacket from the slide as a result of this vertical force is ensured by the barrel which fixes the jacket to the slide, so that functionality of the firearm is ensured.

If the cartridge is drawn by the slide which moves to the rear under the influence of the gas pressure after a shot is fired, the flat spring presses the cartridge case further in the downward direction, so that it is moved downwardly relative to the barrel axis towards the cartridge ejector and strikes the cartridge ejector as in operation with a tilting barrel. The cartridge case rebounds on the cartridge ejector and is thus ejected through the ejecting opening.

It is advantageous if a control pin is arranged on the housing in a positionally fixed manner and if the control pin, in contact with the flat spring, presses the flat spring in the direction of the cartridge ejector. The control pin presses the flat spring in the direction of the cartridge ejector during a return movement of the slide. This offers the advantage that the flat spring is controlled by the control pin, thus allowing the spring rate of the flat spring to be lower. This is advantageous for functional reliability because a weaker flat spring brakes the slide less strongly during the supply of the cartridge. It is a further advantage that as a result of the lower spring force in combination with the control pin the jacket is not lifted from the slide when the cartridge is supplied.

A replacement barrel which can rigidly be connected to the grip is advantageously provided, which replacement barrel can preferably be inserted into the slide from the front. The intrinsic accuracy of the firearm is thus increased because the barrel will no longer tilt after firing a shot, as a result of which a position of the barrel to a target device always remains the same. The replacement barrel is usually releasably connectable to the grip, so that the firearm can be converted easily and reversibly from a Browning system with a tilting barrel to a firearm with a rigid barrel. In order to further increase the precision, especially the intrinsic accuracy, of the firearm, it has turned out to be positive that the replacement barrel is formed in a longer way than the movable or tilting barrel which is usually situated in the firearm.

The replacement barrel is preferably formed in such a way for simple mounting that it can be inserted from the front through the opening into the slide. The replacement barrel, which is advantageously substantially formed in a rotationally symmetrical manner and usually in a cylindrical manner, usually comprises different diameters over the length of a barrel and shoulders at a transitional point between the different diameters so that a defined stop of the replacement barrel on a mounted position is provided.

The replacement barrel can be connected directly to the grip or indirectly via an intermediate element, usually by screws and/or clamps. A simple and sturdy configuration is obtained when a housing is provided which is releasably connectable to the grip and through which the replacement barrel can be indirectly connected to the grip, preferably in a friction-locked manner. The housing can also be formed for an interlocking and friction-locked connection in order to achieve high fitting accuracy with the grip. A connection between the housing and the replacement barrel can occur by a threaded part arranged in the housing for example, to which the replacement barrel can be fixed by means of a union nut or any other fixing means. A groove or a flat point can be provided on the replacement barrel, especially on a shoulder of the replacement barrel, and a corresponding elevation on the threaded part in order to achieve a stable, interlocking and friction-locked connection. This also allows a simple insertion of different replacement barrels with different barrel lengths.

A highly stable connection between the housing and the grip is produced in a constructionally simple way if two half-shells are provided which have a negative shape of a portion of the grip and are connectable on the one hand to the grip and on the other hand to the housing. A large contact surface with low pressing between the half-shells and the grip is thus achieved, so that wear and tear is reduced when the half-shells are connected to the grip in an interlocking manner. On the other hand, a connection with the housing can be produced in a simple and rapid way, e.g. by a shaft connecting the housing and the half-shells, which shaft is preferably fixed by means of a quick-release lever and a shaft fixing nut. A transfer of force between the housing and the half-shells thus occurs over a large surface area and with low surface pressing, especially when a shaft of large diameter is used. In order to minimise loading of the grip, an insertable support can also be provided in the housing on a rear side of the grip, through which a stable connection is achieved between the grip and the housing. In the case of firearms with a hammer such as the Colt M1911 pistol, it is advantageous if no respective support is provided in order to achieve good usability of the hammer. The housing can be formed similar to a shaft system that is known under the trade name KPOS system.

A connection between the half-shells and the housing with a high fitting accuracy can be produced by a shaft with a semicircular cross-section which is mounted in the housing. A simple and rapid fixing capability is thus further achieved. For this purpose, the shaft is inserted into the half-shells through a guide with a cross-section according to a narrow side of the semicircular cross-section and twisted by 180° on a shaft fixing recess with a cross-section according to a broadside of the semicircular cross-section, thus producing an interlocking connection. In contrast to the KPOS system, fixing occurs by pivoting the quick-release lever by 180°, so that the quick-release lever can be pivoted after fixing into the recess and a position of the quick-release lever is irrelevant in contrast to the KPOS system. The handling capability is thus improved.

A so-called picatinny rail can additionally be provided on the half-shells, so that further accessories can be connected to the grip via the half-shells.

A feed ramp is usually part of the barrel and is connected thereto in a material bonded manner at a rear end of the barrel, via which cartridges following from the magazine are guided into the chamber. This is usually not possible due to the size of the opening in the slide in the case of a replacement barrel which can be inserted from the front into the slide. In order to still ensure the supply of cartridges, a feed ramp is advantageously provided, which feed ramp can be inserted especially through the ejecting opening into the firearm. A connection of this separate feed ramp with the grip usually occurs in interlocking manner, preferably on a control cam or a chain-link shaft which defines a tilting movement in a tilting barrel, through which the feed ramp is fixed in the longitudinal direction. It is advantageous if the feed ramp is finally fixed by insertion of a replacement barrel, which mostly reaches up to the feed ramp in the installed state. This can occur for example by interlocking fixing of the feed ramp in the control cam, wherein the feed ramp is fixed between the control cam and the replacement barrel.

It can advantageously further be provided that the feed ramp comprises two cartridge feed protrusions. Since the barrel no longer travels back and tilts, the feed path for the cartridge is longer. The cartridge feed protrusions act like an extension of the magazine lips of the magazine, so that it is ensured that the cartridge is forcibly guided up to the chamber, thus preventing jams.

The precision of the firearm can easily be improved further when a shoulder stock is provided which can be connected to the firearm. As a result, the weapon can then be easily be placed on the shoulder, thus providing improved aiming. The shoulder stock can usually be connected indirectly by the housing. A foldable connection between the housing and the short the stock is usually provided for this purpose, so that the housing can be stowed with little space on the one hand and the shoulder stock can be folded rapidly to a shooting position when required on the other hand.

Timely closure of the slide and rapid loading of a converted firearm are ensured in a simple way when a replacement closing spring for returning the slide after firing a shot is provided, which spring has a higher stiffness than a closing spring used in the firearm. Rapid loading is ensured as a result of the increased stiffness, despite the masses which are increased by the jacket and need to be accelerated during a loading movement. The replacement closing spring can be inserted instead of the original closing spring, or it can be an additional spring which is switched in parallel to the originally inserted closing spring. For example, an additional closing spring can be connected in a rear region of the housing on the one hand and in the jacket on the other hand, so that a total spring stiffness is increased even when using the original closing spring. Especially simple converting is possible if instead of an original closing spring a stiffer closing spring is used. For example, a closing spring of a pistol of type Glock 17 can be used for converting a pistol of the type Glock 19. The spring force is obtained depending on the selected length of the replacement barrel and the mass of the jacket. A stronger replacement closing spring can thus also be required in the case of a lighter jacket. The original closing spring can principally also be inserted, depending on the adjustment of the barrel length and the mass of the jacket.

It is advantageous if the feed ramp comprises a stop protrusion, which stop protrusion is provided to be arranged indirectly between a closing spring of the firearm, especially the replacement closing spring of the firearm, and the grip in order to transfer the spring force of the closing spring, especially the replacement closing spring, to the grip. The grip is protected by the stop protrusion for the closing spring or the replacement closing spring, which grip is often made of plastic such as in the case of a Glock pistol. In this case, the complete spring force of the closing spring or the replacement closing spring is not absorbed directly by the grip, but is distributed by the stop protrusion of a large area onto the grip. This is especially advantageous when using a replacement closing spring with a higher spring force than the original closing spring.

It is advantageous if a firearm with a grip, a slide having an ejecting opening and a cartridge ejector is converted with a conversion set in accordance with the invention. The precision of the firearm can thus be improved in a simple manner and at low cost. Since the conversion with the conversion set in accordance with the invention is reversible, the firearm can easily and rapidly be converted back to the original state with a tilting barrel and low weight after use for long ranges.

The second object is achieved in accordance with the invention in such a way that a conversion set in accordance with the invention is used for converting a firearm with a movable barrel to a firearm with a rigid barrel. As a result, the intrinsic accuracy of a firearm thus improved in a simple way.

A further object is achieved in accordance with the invention in such a way that in a method of the kind mentioned above for converting a firearm for use of a replacement barrel which does not lock the slide a jacket is releasably connected to the slide, wherein the jacket has a defined mass for the predetermined movement of the slide after firing a shot. Since an additional weight for the slide is formed by the jacket, timely opening of the slide is ensured in a simple manner even when using a rigid replacement barrel which does not lock the slide. A connection of the jacket with the slide usually occurs in interlocking manner by a jacket surrounding the slide.

In order to ensure an ejection of the cartridge case even in the case of firearms with a cartridge ejector positioned beneath a barrel axis, a return device is appropriately connected to the firearm, through which a force can be exerted on a cartridge case situated in the slide approximately in the direction of a cartridge ejector arranged in the firearm. This is usually a flat spring fixed in the jacket.

Long ranges and improved precision can be achieved in a simple way when the barrel is replaced by a replacement barrel which is rigidly connected to the grip.

It is advantageous for simple conversion if the replacement barrel is inserted into the slide from the front. This further allows the simply use of a replacement barrel which is longer relative to an originally inserted barrel.

The firearm is appropriately connected in a preferably friction-locked manner to a housing which indirectly connects the replacement barrel to the grip. As already explained above, this usually occurs by half-shells which are connected to the grip in a friction-locked and/or interlocking manner.

In order to ensure the feed of a cartridge when using a replacement barrel, it is advantageous if a feed ramp is inserted through the ejecting opening into the firearm and is connected to the grip in an interlocking manner.

As an alternative to an insertion of the feed ramp through the ejecting opening into the firearm, the feed ramp can also be connected in an interlocking manner to the grip prior to the placement of the slide. In this case, the feed ramp can be formed with respect to its shape in such a way that the slide can be slid via the feed ramp onto the grip. Conversion can thus occur in a simpler way.

The further object is achieved in accordance with the invention in such a way that in a method of the kind mentioned above for operating a firearm a replacement barrel which does not lock the slide is inserted and the breech only opens after a predetermined period of time after firing the shot as a result of a jacket with a defined mass which is releasably connected to the slide. Long ranges in combination with improved precision can thus be achieved with a conventional firearm. Furthermore, the firearm can simply be converted back to the original state with a tilting barrel because the jacket and the replacement barrel are usually reversibly connectable to the firearm. The predetermined period of time after which the slide opens is mostly the time within which a gas pressure in the replacement barrel has dropped to a non-critical value.

A force is preferably exerted on a cartridge case in the direction of a cartridge ejector arranged in the firearm by a return device which is connected to the firearm, as a result of which the cartridge case strikes the cartridge ejector during a movement of the slide to the rear and is ejected through the ejecting opening. This ensures that the ejection of a cartridge is ensured even when a firearm is used with a cartridge ejector arranged beneath the barrel axis.

BRIEF DESCRIPTION OF THE DRAWING

Further features, advantages and effects of the invention are provided from the embodiments which are shown below. The drawings, to which reference is hereby made, show the following.

DETAILED DESCRIPTION OF THE PREFERRED EMBODIMENTS

Figure 1:
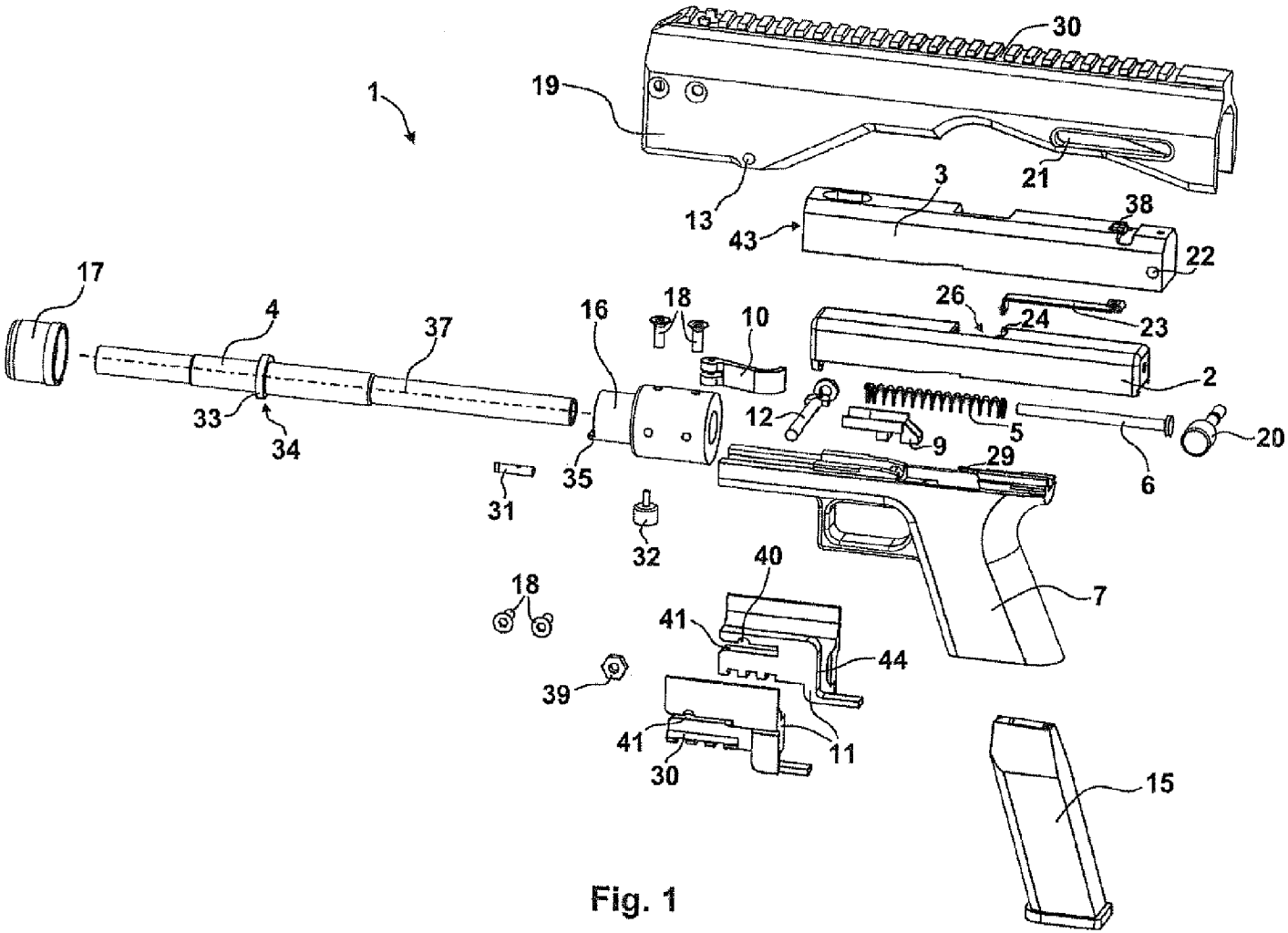
FIGS. 1 and 2 show exploded views of a first preferred embodiment of a converted firearm.
Figure 2:
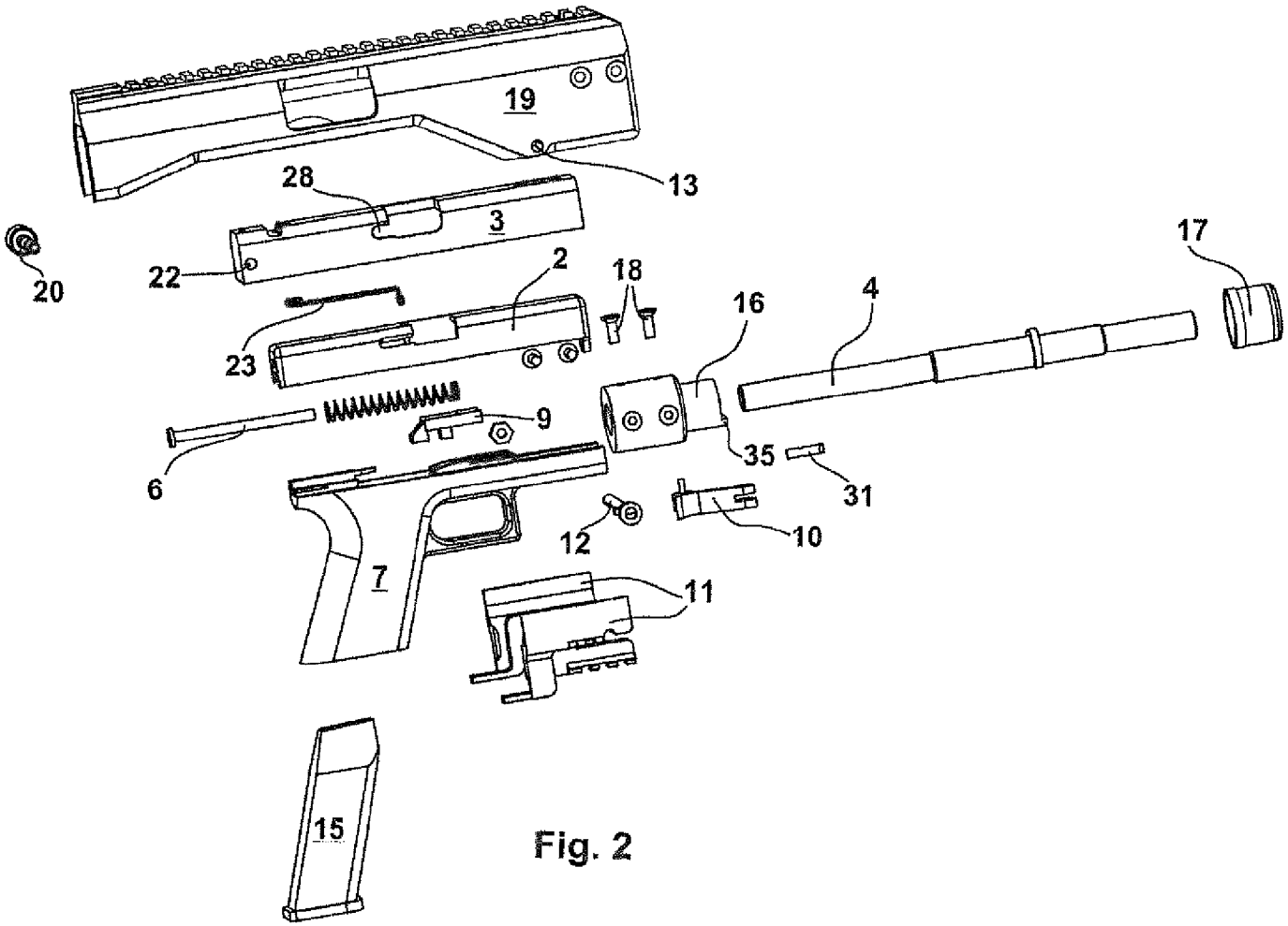

FIGS. 1 and 2 show an exploded view of a first preferred embodiment of a firearm 1 which is equipped with the conversion set in accordance with the invention. The illustration shows a converted Glock pistol, which usually comprises a tilting barrel which closes a slide 2 according to the Browning system.

In order to achieve longer ranges and improved precision with the Glock pistol, a replacement barrel 4 is inserted instead of the original barrel in the converted firearm 1, which replacement barrel is connected via a threaded part 16 and a housing 19 to the original grip 7 of the Clock pistol.

Since the replacement barrel 4 is non-tilting and non-movable and is formed without a locking comb corresponding to the slide 2, the replacement barrel 4 does not close the slide 2 even when a shot is fired.

A constructionally simple configuration of the conversion set is achieved because the original slide 2 of the Glock pistol is inserted into a firearm 1 converted in accordance with the invention. In order to ensure timely opening of said slide 2 after firing a shot, despite the use of a replacement barrel 4 which does not lock the slide 2, a jacket 3 surrounding the slide 2 is provided, which jacket has an inner contour which corresponds to the outer contour of the slide 2. It is releasably connected thereto for increasing the mass of the slide 2.

For producing a connection between the slide 2 and the jacket 3, the jacket 3 is placed on the slide 2. A jacket opening 43, which is preferably round and corresponds to the replacement barrel 4, is provided on a front side of the jacket 3, through which the replacement barrel 4 can be inserted into the slide 2 and can be connected to the firearm 1. The jacket 3 is thus fixed on the slide 2 and a detachment is simply prevented, even in the case of a movement of the slide 2 relative to the grip 7. When a cartridge 36 is inserted, the jacket 3 is further connected to the slide 2 on a fixing recess 28 by a cartridge extractor 27 which is pressed laterally to the outside.

The replacement barrel 4 is connected to the grip 7 by a housing 19 by means of a threaded part 16, wherein the threaded part 16 in the housing 19 is fixed by fixing screws 18. The replacement barrel 4 is connected to the threaded part 16 by means of a union nut 17, as is also the case in other weapons, e.g. in a so-called Uzi. An elevation 35 is provided on the threaded part 16 for a secure interlocking connection, which elevation corresponds to a flat point 34 on a shoulder 33 of the replacement barrel 4. The union nut 17 is fixed to the threaded part 16 in a closed state by a securing pin 31 and a securing-pin fixing screw 32.

A connection of the housing 19 with the grip 7 occurs on the one hand in an interlocking manner by an inner contour of the housing 19, which inner contour corresponds to the shape of the grip 7. On the other hand, an interlocking and friction-locked connection between the housing 19 and the grip 7 occurs indirectly by two half-shells 11 arranged between the housing 19 and the grip 7. They respectively comprise a half-shell inner contour 44, which corresponds to a portion of the grip 7 and which enables a large-area connection with the grip 7, so that surface pressing and wear and tear are minimised. A connection between the half-shells 11 and the housing 19 is realised by a shaft 12 mounted in boreholes 13 of the housing 19, which shaft has a non-round cross-section at least in part, preferably a semicircular cross-section. A guide 41 and a shaft fixing recess 40 are provided in the half-shells 11 corresponding thereto, wherein the shaft 12 can only be guided through the guide 41 up to the shaft fixing recess 40 with a cross-section twisted to a specific position. In the illustrated embodiment, a centre of gravity of the shaft 12 must be twisted downwardly for this purpose. The shaft 12 is twisted by 180° on the shaft fixing recess 40, so that a stable connection is produced on a contact surface between the shaft 12 and the shaft fixing recess 40 and between the half-shell inner contours 44 and the grip 7. In order to fix the shaft in this position, a quick-release lever 10 is provided at one end of the shaft 12 and a shaft fixing nut 39 at a further end of the shaft 12, so that the shaft 12 can be fixed in a friction-locked manner to the housing 19.

The replacement barrel 4 is formed in a substantially rotationally symmetrical way for insertion from the front into the slide 2, and in contrast to an originally inserted barrel does not comprise an end-side feed ramp 9 for the feed of a cartridge, which is why the conversion set comprises a separate feed ramp 9, which can be inserted especially through the ejecting opening 26 into the firearm 1 can be connected in an interlocking manner to the grip 7 prior to the placement of the slide 2 on the grip 7.

In the case of Glock pistol, a cartridge ejector 29 is mostly arranged beneath a barrel axis 37 or beneath a chamber 8. As a result of the originally tilting barrel, a cartridge case is accelerated downwardly in the direction of the cartridge ejector 29 after a shot is fired and is ejected by rebounding therefrom. In order to achieve a secure ejection of the cartridge case after conversion despite the inserted replacement barrel 4 which is rigidly connected to the grip 7, a flat spring 23 connected to the jacket 3 is provided, which presses the cartridge case in the downward direction so that a cartridge case strikes the cartridge ejector 29 during return movement of the slide 2 after a shot is fired and is subsequently ejected through the ejecting opening 26. The flat spring 23 is bent, and is fixed in a fastening depression 38 at the end side on the jacket 3 and is formed in a dimension which corresponds to a groove 24 of the slide 2. As a result, the flat spring 23 can be inserted via the groove 24 of the slide 2 through the slide 2 into the firearm 1.

In order to bring the slide 2 and the jacket 3 from a rear end position back to the front position or loading position after firing a shot, a replacement closing spring 5 is provided which is guided by a recoil spring guide 6 of the original Glock pistol. Depending on the adjustment, the replacement closing spring 5 can have a higher stiffness than a closing spring that is usually inserted into the firearm in order to initiate a forward movement with respective acceleration despite increased masses to be accelerated and in order to enable rapid loading.

A slide catch which extends the slide catch of the slide 2 is further provided on the jacket 3 so as to increase a contact area and to prevent impermissibly high pressing on the slide catch of the slide 2.

An original magazine 15 of the Glock pistol is used in the illustrated embodiments. A larger longer magazine 15 can also be inserted alternatively in order to increase the cartridge capacity.

A picatinny rail 30 is provided on an upper side of the housing 19, on which further accessories can releasably be mounted, e.g. an aiming device. Furthermore, respective rails for mounting additional accessories can also be arranged laterally on the housing 19. A respective picatinny rail 30 is advantageously also arranged on a bottom side of the half-shells 11, so that the conversion set can be expanded in a simple way.

The jacket 3 comprises a cocking slide opening 22, in which a cocking slide 20 can releasably be fixed, so that the converted firearm 1 can also be manually loaded in a simple way. The cocking slide 20 which moves the jacket 3 and the slide 2 can be moved relative to the housing 19, even when the housing 19 is mounted, by an elongated cocking slide recess 21 which is provided in the housing 19. During conversion, the cocking slide 20 is inserted into the cocking slide opening 22 of the jacket 3 through the cocking slide recess 21 of the housing 19 after the jacket 3 and the housing 19 are mounted.

Figure 3:
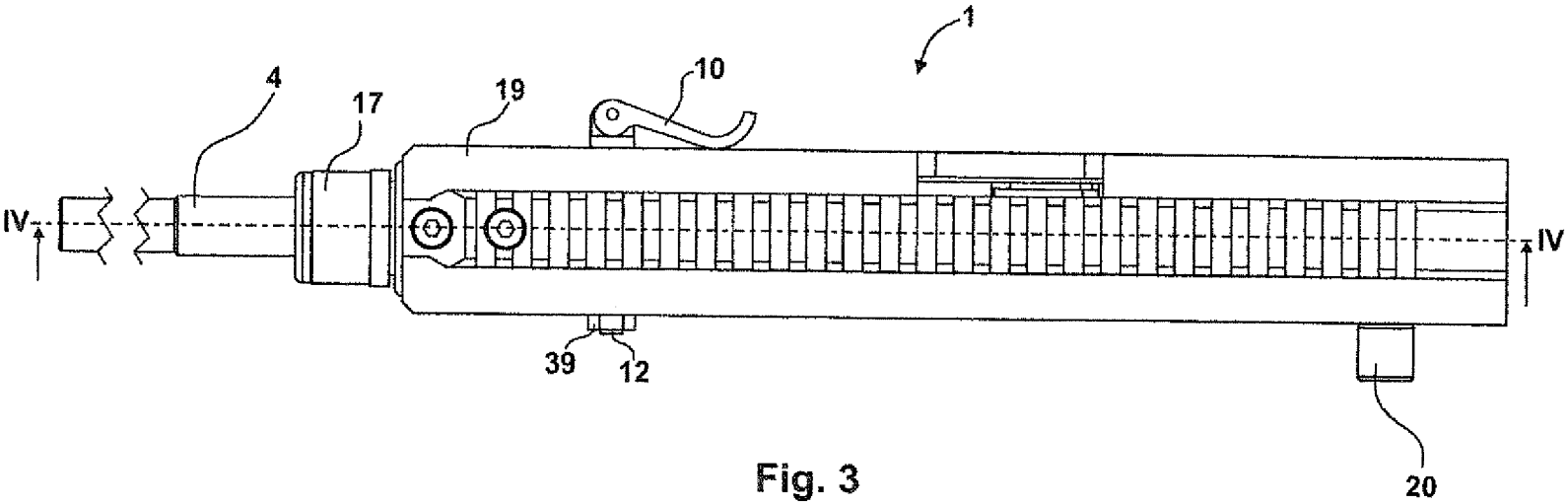
FIG. 3 shows a top view of the first preferred embodiment of a converted firearm.

FIG. 3 shows a top view of the first preferred embodiment of a firearm 1 which is equipped with a conversion set in accordance with the invention. The housing 19 is connected to the grip 7 by the shaft 12, which is fixed to the housing 19 by means of the quick-release lever 10 on the one hand and by means of a shaft fixing nut 39 on the other hand. The illustration further shows the replacement barrel 4 which is connected by the union nut 17 to the housing 19 and the cocking slide 20 which is situated in the rear end position, by means of which the firearm 1 can be loaded manually.

Figure 4:
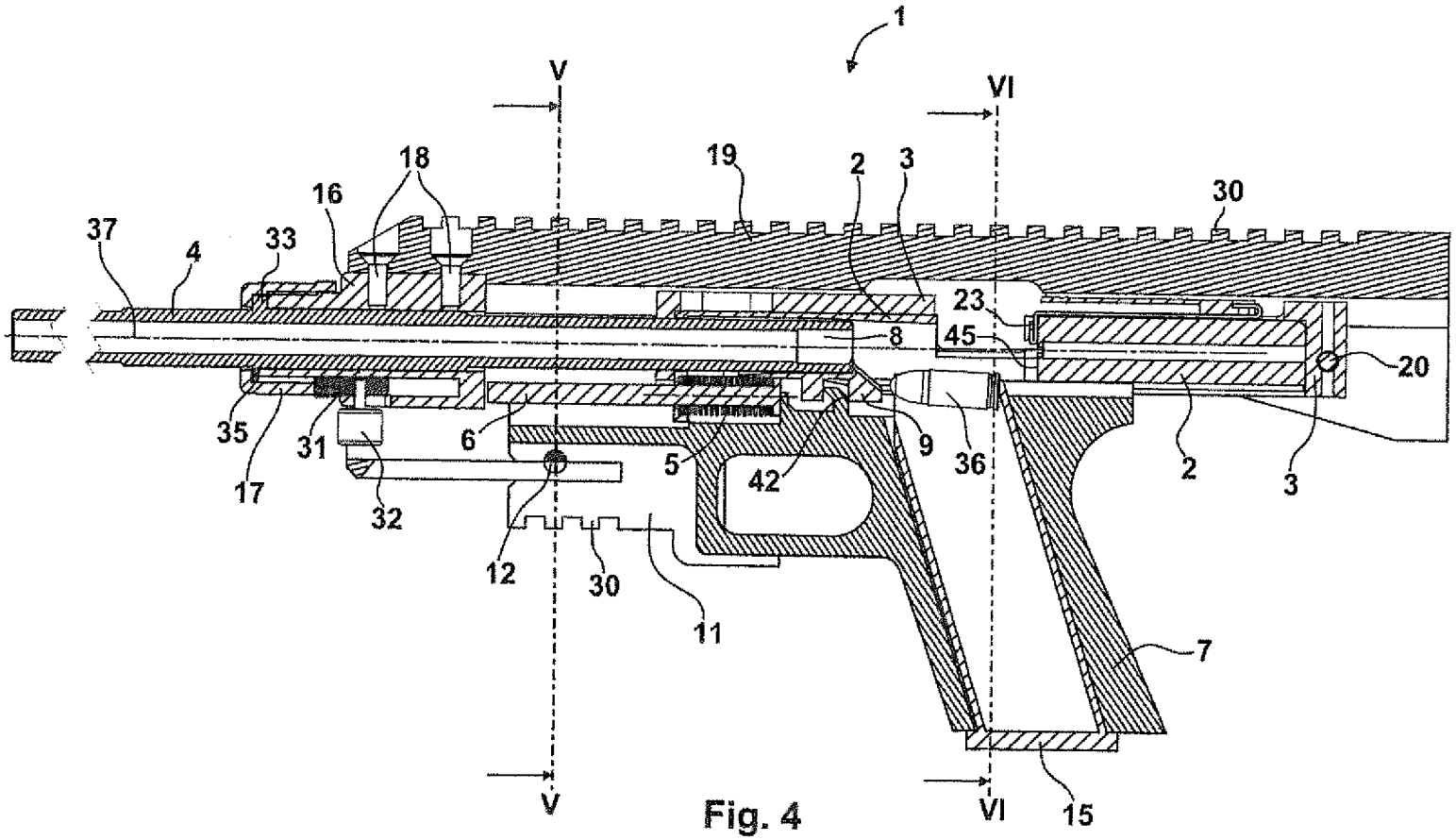
FIGS. 4 to 8 show sectional views of a firearm equipped with a first preferred embodiment of the conversion set.

FIG. 4 shows a sectional view through a firearm 1 along the line IV-IV in FIG. 3. The illustration shows that the slide 2 and the jacket 3 are situated in a rear end position, wherein the replacement closing spring 5 is compressed. During a forward movement of the slide 2, the cartridge 36 is guided via the feed ramp 9 into the chamber 8 under relaxation of the replacement closing spring 5, wherein the forward movement of the slide 2 is transferred by a slide face 45 to the cartridge 36. At the same time, the cartridge 36 is pressed upwardly during the forward movement by the feed ramp 9, wherein the flat spring 23 is pressed elastically in the upward direction. The feed ramp 9 is arranged on a control cam 42 in the grip 7 as illustrated, and is fixed by the replacement barrel 4 which is rigidly connected to the grip 7.

It is further shown that the housing 19 is connected to the half-shells 11 by the shaft 12, wherein the semicircular cross-section of the shaft 12 is upwardly twisted in the shaft fixing recess 40 in order to produce an interlocking connection.

As is illustrated, the barrel is connected to the grip 7 by the union nut 17 and the threaded part 16, wherein the threaded part 16 is fixed in the housing 19 by the fixing screws 18. A connection between the union nut 17 and the threaded part 16 is ensured by a securing pin 31 and a securing-pin fixing screw 32.

Figure 5:
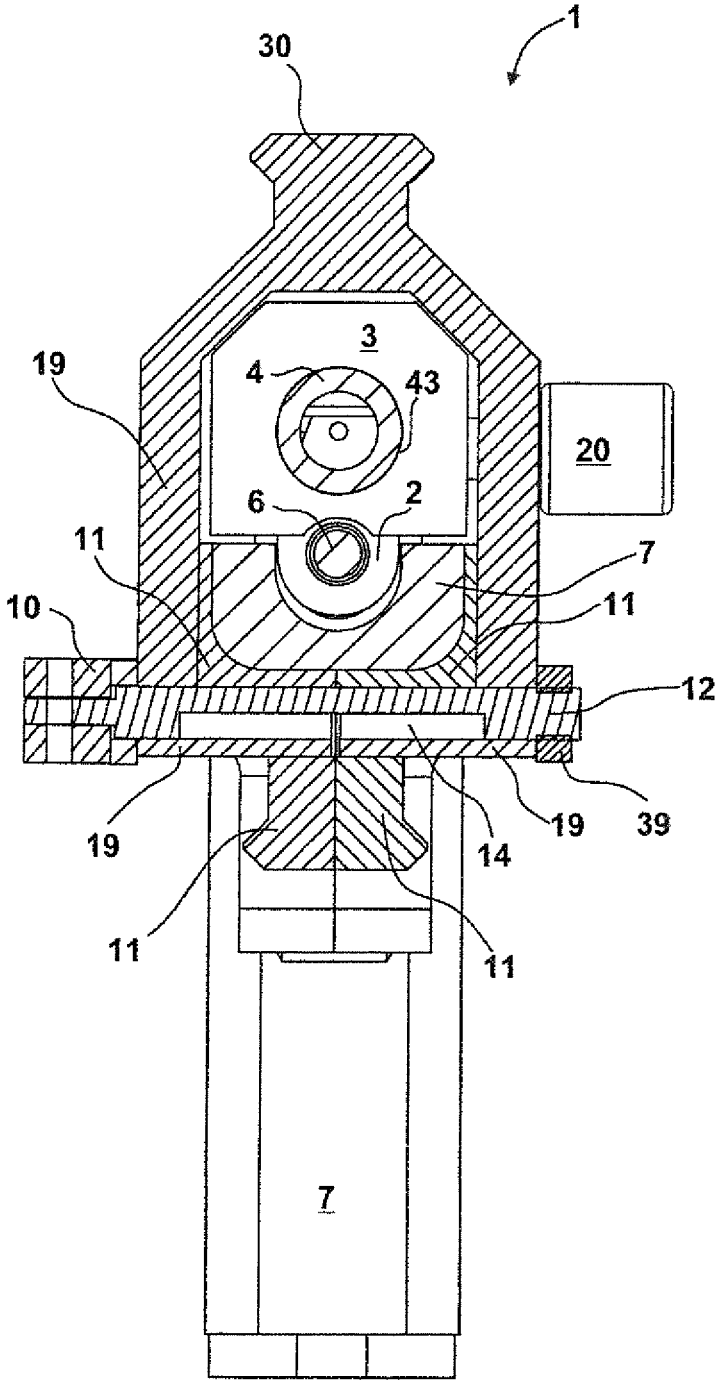

FIG. 5 shows a sectional view through a firearm 1 along the line V-V in FIG. 4. The illustration shows the fixing of the housing 19 on the half-shells 11 by the shaft 12 by means of the semicircular cross-section of the shaft 12 in a middle region. A shaft recess 14, which is the result of the semicircular cross-section and is approximately rectangular in the axial section, allows an insertion of the shaft 12 into the guide 41 of the half-shells 11 when the shaft 12 is twisted in relation to the illustrated position by 180°. In the illustrated position, the shaft 12 is fixed by the quick-release lever 10 and the shaft fixing nut 39.

The illustration further shows that the housing 19 has a dovetail-like cross-section on an upper side and the half-shells 11 on a bottom side. With a respective profile, a picatinny rail 30 is respectively formed for accommodating accessories.

Figure 6:
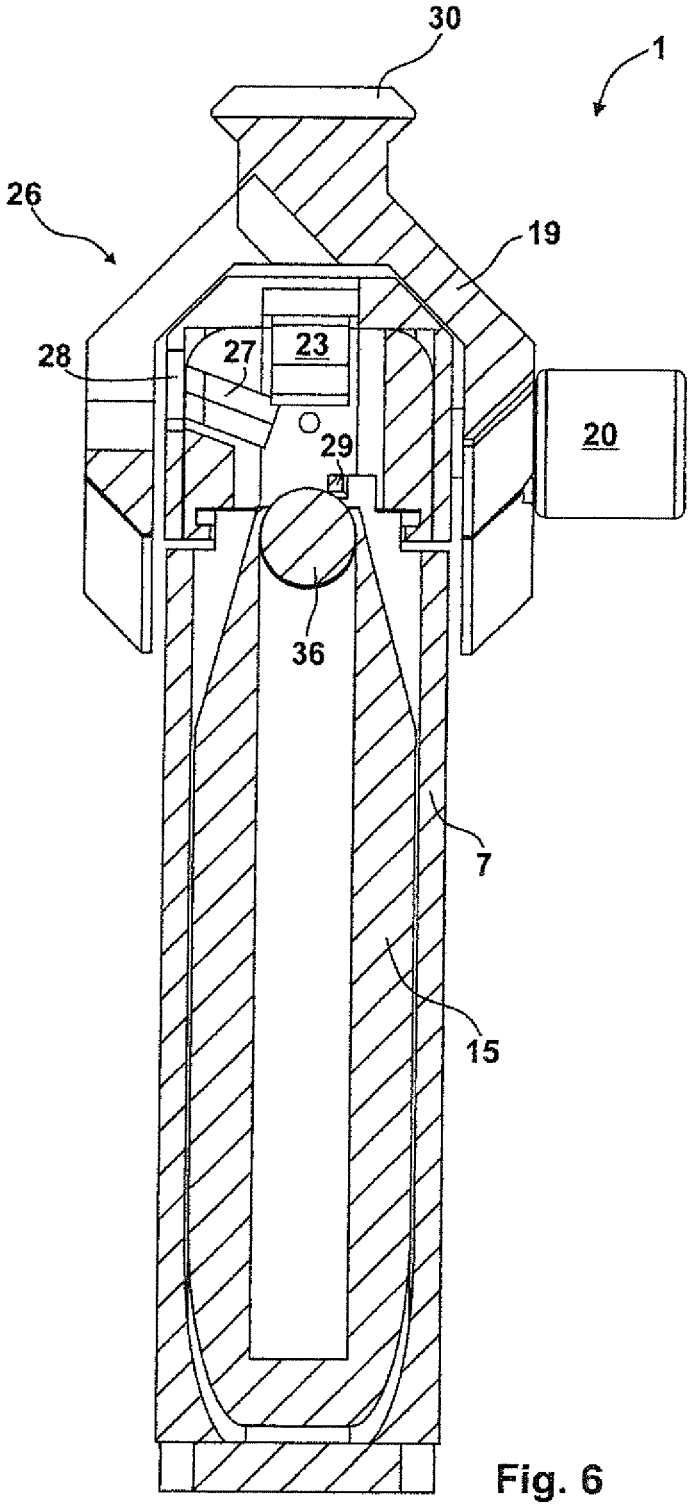

FIG. 6 shows a sectional view through a firearm 1 along the line VI-VI in FIG. 4. The illustration shows that a cartridge 36 is positioned at an upper end of a schematically illustrated magazine 15. The illustration further shows a cartridge extractor 27 and the flat spring 23, which are elastically moved during loading of the cartridge 36. The cartridge ejector and 7, which is formed in a resilient manner, is moved to the side, wherein it engages in a fixing recess 28 of the jacket 3 and thus fixes the same in an interlocking manner to the slide 2. The return device which is shown in a relaxed position and is formed as a flat spring 23 is pressed upwardly during loading of the cartridge 36, wherein a force is exerted on the cartridge 36 in the downward direction. The illustration further shows the cartridge ejector 29, from which a cartridge case rebounds after a shot is fired and is ejected through the ejecting opening 26 formed in the slide 2 and in the jacket 3.

Figure 7:
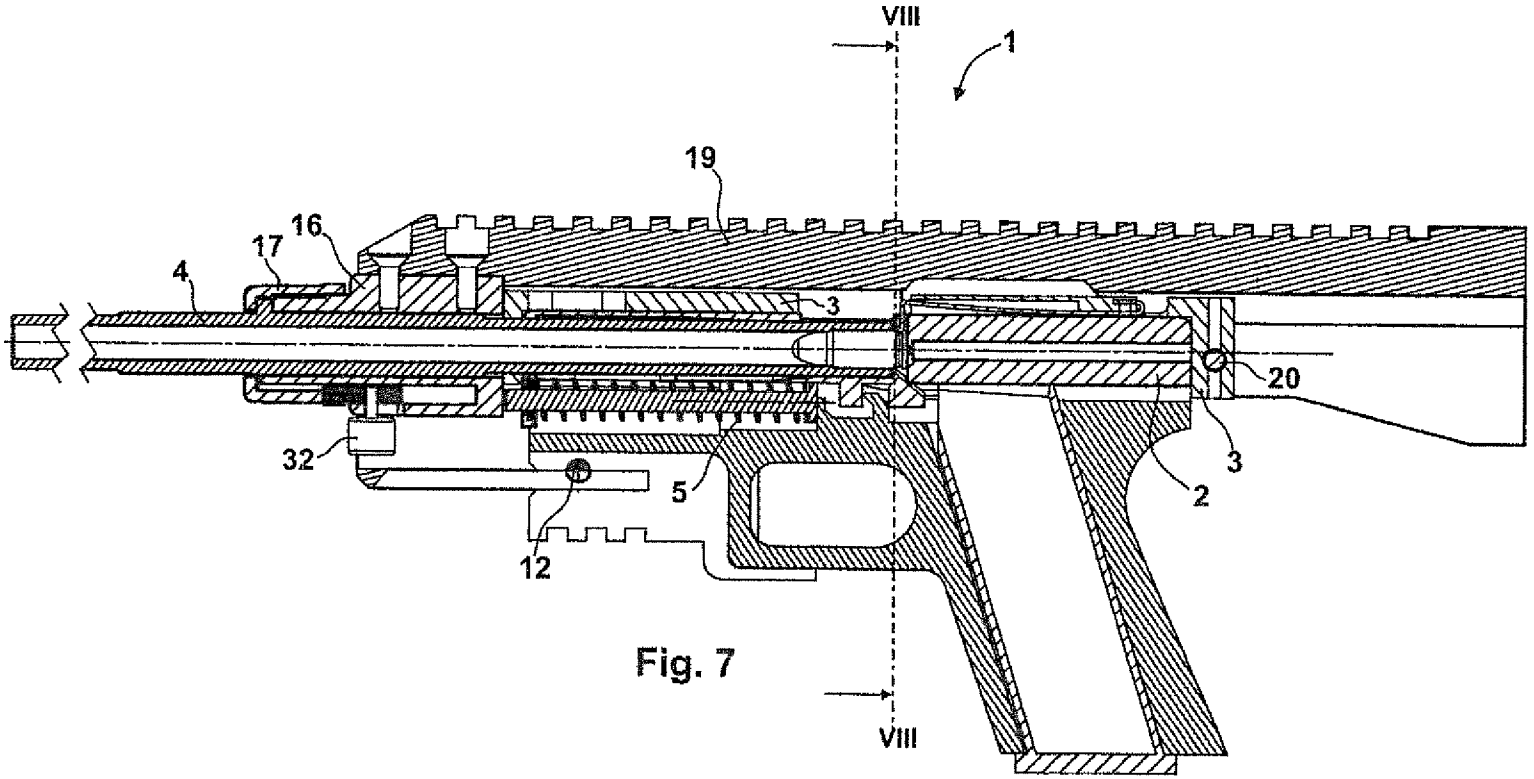

FIG. 7 shows the first preferred embodiment of a firearm 1 according to FIG. 3, wherein the slide 2 and the jacket 3 have been moved from the rear end position back to the front end position and the replacement closing spring 5 is relaxed. Furthermore, a cartridge 36 is in the chamber 8, so that the firearm 1 is loaded. The flat spring 23 is elastically deformed by the cartridge 36 and is pressed upwardly, which is why it exerts a force on the cartridge 36 in the downward direction.

Figure 8:
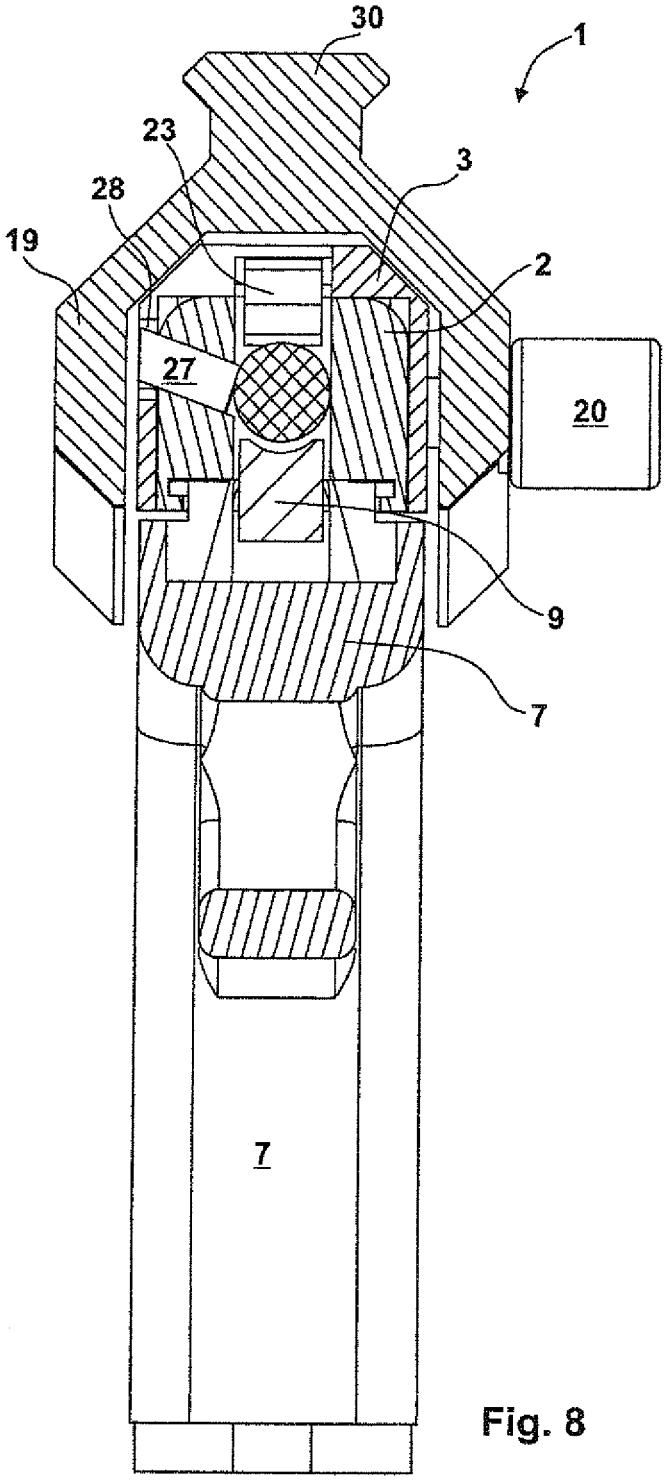
Figure 9:
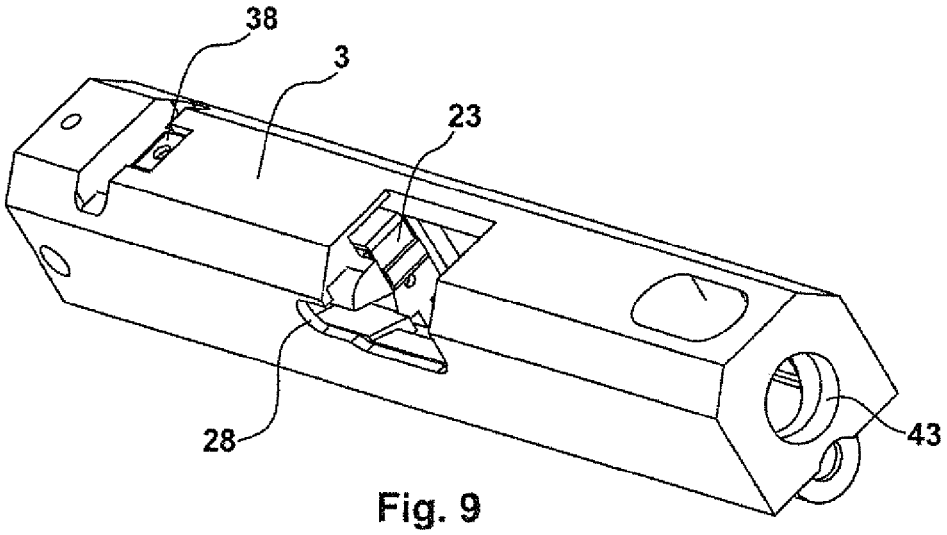
FIGS. 9 to 12 show a detail of the first preferred embodiment of a converted firearm in different views.
Figure 10:
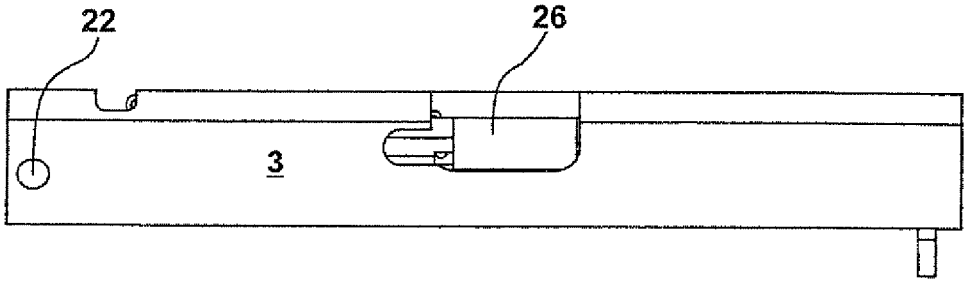
Figure 11:
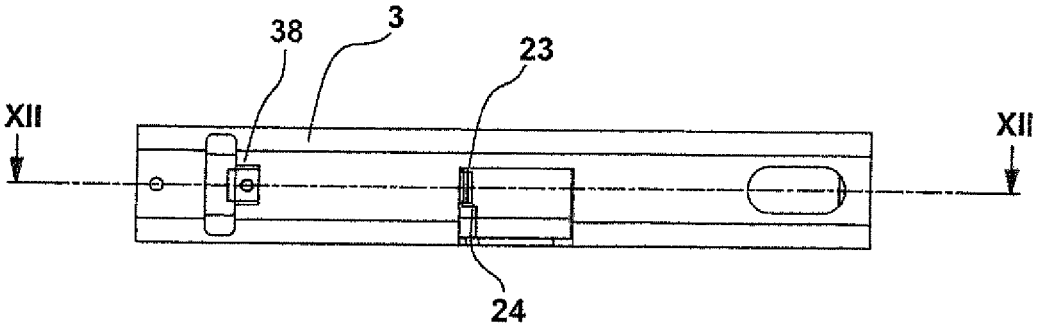

FIG. 8 shows a sectional view through a firearm 1 along the line VIII-VIII in FIG. 7. As is shown in the illustration, the jacket 3 is fixed in the illustrated position to the slide 2 by the outwardly displaced cartridge extractor 27 because the cartridge extractor 27 engages in the fixing recess 28 of the jacket 3. This ensures an interlocking fixing of the jacket 3 on the slide 2.

Figure 12:
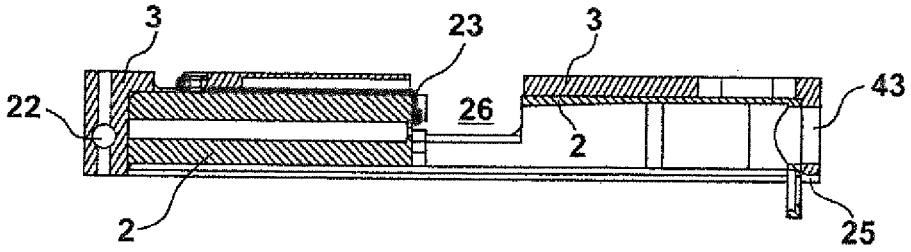

FIGS. 9 to 12 show a detail of a converted firearm 1 according to the first preferred embodiment in different views, wherein an assembly is shown which consists of the jacket 3 plus the slide 2 and the flat spring 23. FIG. 12 shows a sectional view through the assembly along the line XII-XII in FIG. 11. The illustration shows that the jacket 3 surrounds the slide 2, so that an interlocking connection is provided. The illustration further shows that the flat spring 23 which is fixed in the fastening depression 38 is arranged between the jacket 3 and the slide 2 and protrudes into the firearm 1 through the grooves 24. The illustration further shows the ejecting opening 26 and the fixing recess 28, into which the cartridge extractor 27 engages when a cartridge 36 is loaded in order to fix the jacket 3 to the slide 2. The jacket opening 43 is provided at the front end of the jacket 3, through which the replacement barrel 4 can be inserted into the firearm 1. A recess 25 for the recoil spring guide 6 is provided at a front end of the jacket 3 in order to enable a movement of the jacket 3 to the rear after a shot is fired. The jacket 3 comprises the cocking slide recess 21 in a rear region, in which the cocking slide 20 is connectable to the jacket 3 so that the firearm 1 can also be loaded manually when arranged in the housing 19.

Figure 13:
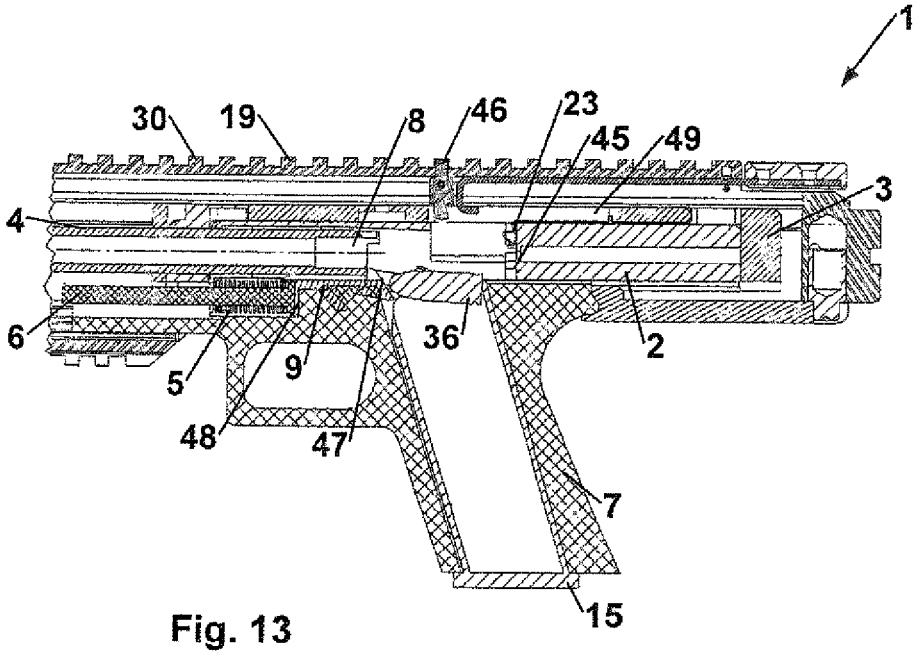
FIGS. 13 and 14 show sectional views of a firearm equipped with a second preferred embodiment of the conversion set.
Figure 14:
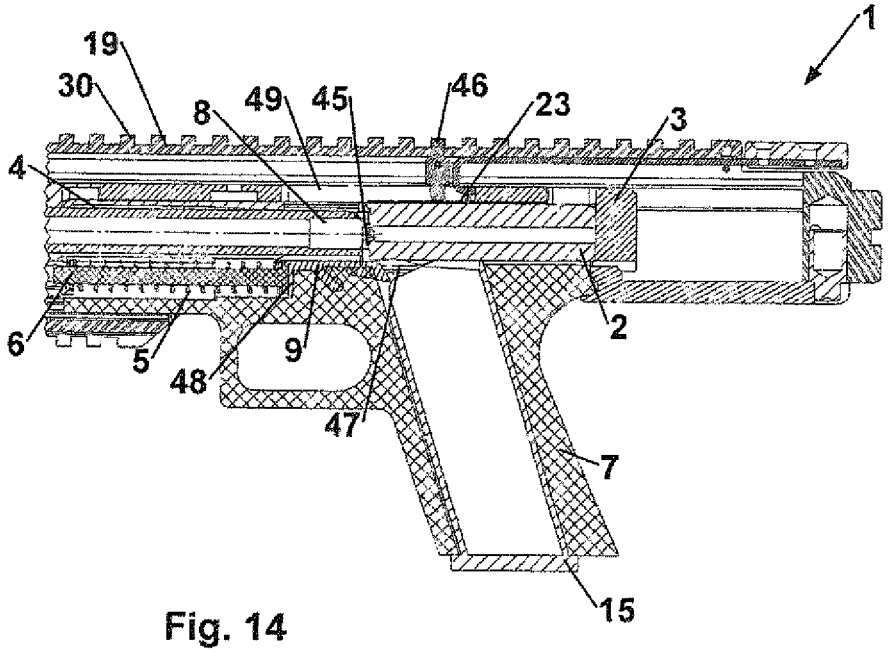

FIGS. 13 and 14 show a second preferred embodiment of the converted firearm 1 as a sectional view in two different states which correspond to the states of FIG. 4 and FIG. 7. Only a rear section of the firearm 1 is shown here. A control pin 46 is arranged on the housing 19, which is especially releasably fixed thereto, wherein the control pin 46 presses the flat spring 23 in the direction of the cartridge ejector 29 upon contact with the flat spring 23. The control pin 46 can be integrally formed on the housing 19 as an alternative. In this case, the control pin 46 is in contact with the flat spring 23 with the slide in the position shown in FIG. 14, but not in the position of the slide shown in FIG. 13. The jacket can have an elongated breakthrough 49 in this case, through which the control pin 46 protrudes in order to establish contact with the flat spring 23.

Figure 15:
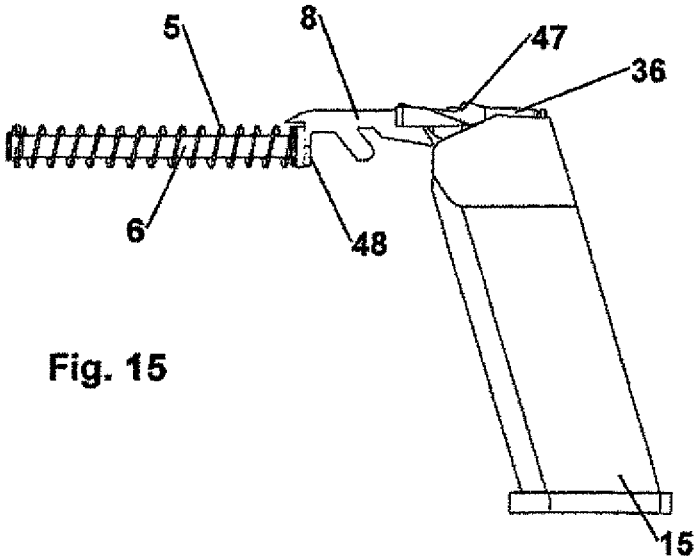
FIGS. 15 and 16 show a detail of the second preferred embodiment of a converted firearm in different views.
Figure 16:
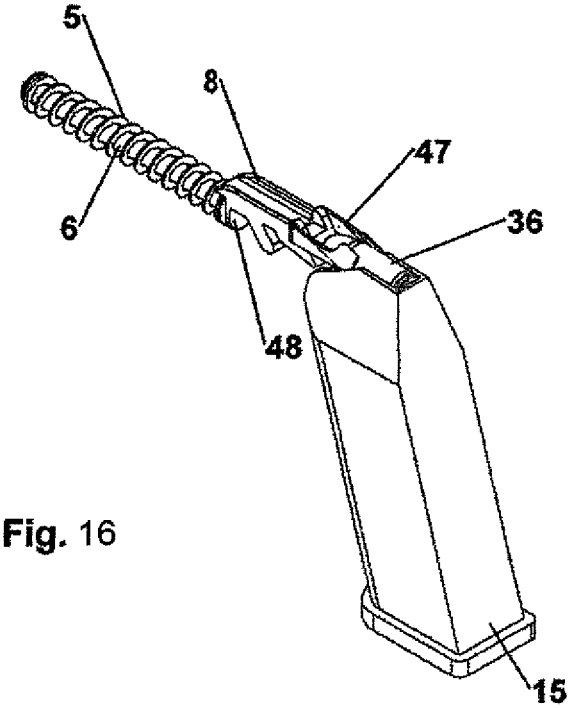

FIGS. 15 and 16 show different views of a detail of a converted firearm 1 according to the second preferred embodiment. In this case, the feed ramp 9 comprises especially two cartridge feed protrusions 47, which are preferably formed as a lateral guide. Forced guidance of the cartridge 36 from the magazine 15 to the chamber 8 is provided by these cartridge feed protrusions 47. The cartridge feed protrusions 47 can especially be integrally formed on a base body of the feed ramp 9.

The illustration further shows that the feed ramp 9 comprises a stop protrusion 48, which stop protrusion 48 is indirectly arranged between the replacement closing spring 5 and the grip 7 in order to transfer the spring force of the replacement closing spring 5 to the grip 7. The stop protrusion 48 is directly arranged between the recoil spring guide 6 and the grip 7 in order to transfer the spring force of the replacement closing spring 5 to the grip 7. The feed ramp 9 can preferably be made of metal. As a result, the grip 7 can be protected from stronger wear and tear when using a replacement closing spring 5 with high spring force. The stop protrusion 48 can especially be formed integrally on a base body of the feed ramp 9.

For the purpose of converting a firearm 1 such as a Glock pistol, the magazine 15 and the slide 2 are released from the firearm 1 and an original barrel and an original closing spring are removed. The replacement closing spring 5 is then fixed to the grip 7 and the slide 2 is connected to the grip 7 again, whereupon the feed ramp 9 is inserted through the ejecting opening 26 into the slide 2 and is arranged on the control cam 42. The feed ramp 9 could alternatively be fixed to the grip 7 prior to the connection of the slide 2 with the grip 7. The jacket 3 is then placed on the slide 2 in a next step, whereupon the housing 19 is connected by the shaft 12 to the grip 7. Finally, the cocking slide 20 is fixed in the cocking slide opening 22 by the cocking slide recess 21 and the replacement barrel 4 is rigidly connected to the grip 7 via the housing 19 connected to the firearm 1 by the threaded part 1 and the union nut 17, through which the feed ramp 9 is fixed to the control cam 42. The jacket 3 is also fixed to the slide 2 by the replacement barrel 4. The magazine 15 can now be reinserted and the firearm 1 can be loaded.

The conversion set in accordance with the invention allows converting a firearm 1 of low mass and low range such as a Glock pistol in a very simple way by changing slide system and the length of a barrel to a carbine system which offers increased ranges of more than 100 m and improved intrinsic accuracy. Conversion can occur rapidly and reversibly, so that a change from a state with a tilting barrel to a state with an extended rigid replacement barrel 4 is possible in a simple way. Since several parts of the original firearm 1 such as the slide 2 and the grip 7 can be used and the additional components required for the conversion set can be produced easily by turning or milling for example, a production of a respective conversion set is possible with little effort.

The production costs of a conversion set in accordance with the invention are only slightly over the production costs of conventional stock systems which are known under the trade names KPOS (Fab Defense) or TRIARII (Hera Arms). In contrast to known stock systems, the range and the intrinsic accuracy of a firearm 1 can also be improved with a conversion set in accordance with the invention.

What is claimed is:

1. A conversion set for a firearm operating according to a Browning system, the firearm having a grip and a slide, the slide being locked by a movable barrel, the slide including an ejecting opening, said conversion set comprising a replacement barrel which does not lock the slide and a jacket connectable to the slide in a detachable, interlocking manner, said jacket having a defined mass for predetermined movement of the slide following a shot being fired and at least substantially surrounding the slide.

2. The conversion set of claim 1, further comprising a return device configured for connection to the firearm to exert a force on a cartridge case situated in the slide approximately in a direction of a cartridge ejector arranged in the firearm.

3. The conversion set of claim 2, wherein the return device is arranged in the jacket.

4. The conversion set of claim 2, wherein the return device is arranged in the jacket at a position which corresponds to the ejecting opening.

5. The conversion set of claim 1, wherein the replacement barrel is rigidly connectable to the grip and insertable into the slide.

6. The conversion set of claim 1, wherein the replacement barrel is insertable into the slide from the front.

7. The conversion set of claim 1, further comprising a housing configured for detachable connection to the grip to thereby indirectly connect the replacement barrel to the grip.

8. The conversion set of claim 7, wherein the replacement barrel is connected via the housing to the grip in a friction-locked manner.

9. The conversion set of 1, further comprising a feed ramp configured for insertion through the ejecting opening into the firearm.

10. A method for converting a firearm operating according to a Browning system using a conversion set comprising a replacement barrel, the firearm having a grip and a slide, the slide being locked by a movable barrel and including an ejecting opening, said method comprising detachably connecting a jacket of the conversion set to the slide for use with the replacement barrel which does not lock the slide, wherein the jacket has a defined mass for a predetermined movement of the slide after a shot is fired, wherein the jacket at least substantially surrounds the slide.

11. The method of claim 10, further comprising connecting a return device to the firearm to exert a force on a cartridge case situated in the slide approximately in a direction of a cartridge ejector arranged in the firearm.

12. The method of claim 10, further comprising replacing a barrel by the replacement barrel which is rigidly connected to the grip.

13. The method of claim 12, further comprising inserting the replacement barrel from a front into the slide.

14. The method of claim 12, further comprising connecting the firearm to a housing which connects the replacement barrel indirectly to the grip.

15. The method of claim 12, further comprising inserting a feed ramp through the ejecting opening into the firearm and connecting the feed ramp in an interlocking manner to the grip.

* * * * *